US005414908A

United States Patent [19]

Haines

[11] Patent Number: 5,414,908

[45] Date of Patent: May 16, 1995

[54] TIE CLIP

[76] Inventor: Patrick R. Haines, P.O. Box 5280, Kent, Wash. 98064-5280

[21] Appl. No.: 964,213

[22] Filed: Oct. 20, 1992

Related U.S. Application Data

[63] Continuation-in-part of Ser. No. 620,933, Dec. 3, 1990, Pat. No. Des. 330,688, and a continuation-in-part of Ser. No. 530,722, May 29, 1990, Pat. No. Des. 336,448.

[51] Int. Cl.[6] ..... A41D 25/00

[52] U.S. Cl. ..... 24/66.4; 24/336

[58] Field of Search ..... 24/3 E, 3 L, 44, 49 R, 24/49 CF, 49 CC, 49 TS, 49 C, 336, 531; D11/202, 78.1; 2/145

[56] References Cited

U.S. PATENT DOCUMENTS

| | | | |
|---|---|---|---|
| D. 29,871 | 12/1898 | Buell . | |
| D. 32,985 | 7/1900 | Musselman . | |
| D. 46,009 | 6/1914 | Singleton . | |
| D. 139,837 | 12/1944 | Tamis . | |
| 167,300 | 8/1875 | Burnham, Jr. . | |
| D. 221,412 | 8/1971 | Laughlin . | |
| D. 239,147 | 3/1976 | Karlson . | |
| D. 244,968 | 7/1977 | Fowble . | |
| D. 295,501 | 5/1988 | Brayford . | |
| 382,754 | 5/1888 | Carder | 24/44 |
| 853,544 | 5/1907 | Fernald | 24/336 |
| 881,757 | 3/1908 | Winsor | 24/3 E |
| 900,193 | 10/1908 | Nelson | 24/336 X |
| 1,520,739 | 12/1924 | Zetlitz . | |
| 1,652,972 | 12/1927 | Beck | 24/3 L |
| 1,726,185 | 8/1929 | Kremski et al. | 24/49 C |
| 2,121,402 | 6/1938 | Knoebel, Jr. . | |
| 2,308,166 | 1/1943 | Fulton . | |
| 2,751,653 | 6/1956 | Leibow . | |
| 2,828,518 | 4/1958 | Robertson . | |
| 2,845,172 | 7/1958 | Fridolph . | |
| 3,100,494 | 8/1963 | Littman . | |
| 3,453,696 | 7/1969 | Matrs . | |
| 3,793,681 | 2/1974 | Casstevens, Jr. et al. . | |
| 3,802,032 | 4/1974 | Weed . | |
| 4,099,300 | 7/1978 | Wolak . | |
| 4,949,432 | 8/1990 | Wizniewski | 24/336 X |
| 5,062,185 | 11/1991 | Howard | 24/49 CC |

FOREIGN PATENT DOCUMENTS

| | | |
|---|---|---|
| 513799 | 6/1955 | Canada . |

*Primary Examiner*—James R. Brittain
*Attorney, Agent, or Firm*—R. Reams Goodloe, Jr.

[57] ABSTRACT

An integral, one piece tie clip. The clip includes a body portion and first and second transverse portions; a first spring portion connects the body and the first transverse portion, and a second spring portion connects the first and second transverse portions. Two garment receiving slots are thus formed, the first between the body and the first transverse portion, and the second between the first transverse portion and the second transverse portion. Both slots are urged toward a normally closed position by their respective spring portions. The first garment receiving slot may be positively actuated to an open position to receive a tie label therein by simply providing a slight amount of manual opening pressure to oppose the spring action. The second garment receiving slot may also be manually actuated to an open position to receive a shirt or blouse therein, and allowed to return to a closed position wherein shirt is frictionally secured. The tie clip thus operates by fixedly attaching to both the tie label and to a shirt or blouse.

11 Claims, 3 Drawing Sheets

FIG. 5
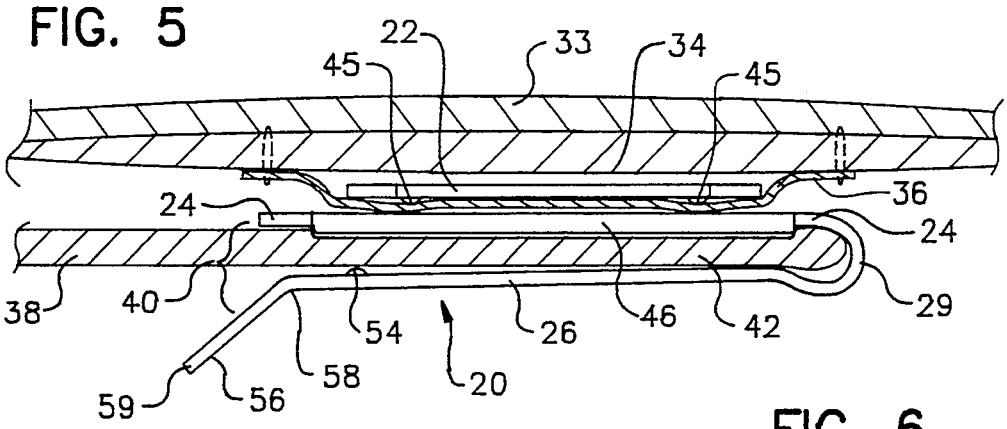
FIG. 6
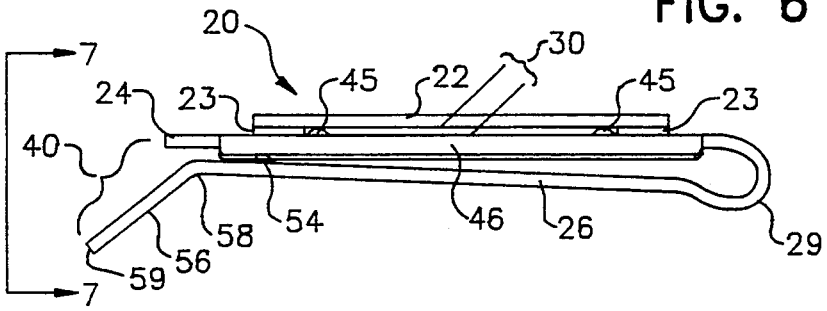
FIG. 7
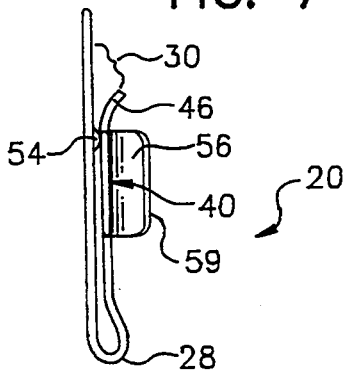
FIG. 8
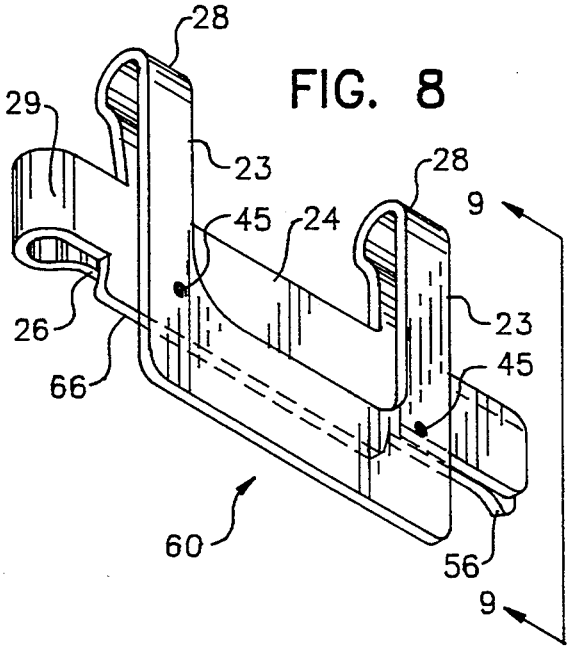
FIG. 10
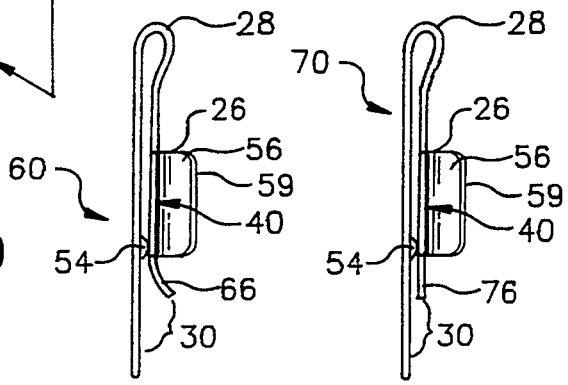
FIG. 9

TIE CLIP

CROSS-REFERENCE TO RELATED APPLICATIONS

The present application is a Continuation-in-Part of my prior application Ser. No. 07/620,933, filed Dec. 12, 1990, to be issued as U.S. Pat. No. D330,688, entitled TIE CLIP; and as a Continuation-in-Part of my prior application Ser. No. 07/530,722, filed May 29, 1990, now U.S. Pat. No. D. 366,448, entitled TIE CLIP; the disclosures of each of those prior applications are incorporated herein by reference.

TECHNICAL FIELD OF THE INVENTION

This invention relates to a novel tie clip for use in affixing a neck-tie adjacent to a shirt or blouse. The tie clip is substantially hidden when used.

BACKGROUND OF THE INVENTION

A continuing demand exists for a simple, unobtrusive, and inexpensive tie clip which can be used to eliminate the movement of a neck-tie relative to a shirt or blouse. Presently, most the most common types of devices to secure ties to a shirt or blouse are visible tie clips and tie pins. Such devices detract attention from the tie, and thus require additional expense to create a pleasing design for viewing.

The need to reduce the cost of tie clips is particularly great at this time, especially for certain types of governmental users for whom my type of hidden tie clip would be particularly useful, such as military or police personnel.

One of the most common deficiencies of the heretofore available tie clip devices of which I am aware is their tendency to distort the flat shape of a tie by either engaging the edges thereof, in the case of a clip, or by compressing the cloth surrounding the device, in the case of a pin. Thus, elimination of such undesirable and neck-tie disfiguring problems would be advantageous.

SUMMARY OF THE INVENTION

I have now invented, and disclose herein, a novel, improved hidden tie clip which does not have the above-discussed drawbacks common to those heretofore used tie clips of which I am aware. Unlike the tie clips heretofore available, my product is simple, lightweight, relatively inexpensive, easy to manufacture, and otherwise superior to those heretofore used or proposed. In addition, it provides an easy to use method for securing a tie to a shirt or blouse.

In accordance with the present invention, I provide a tie clip consisting of an integral, one piece construction including a body portion and first and second transverse portions. Two garment receiving slots are formed, the first between the body and the first transverse portion, and the second between the first transverse portion and the second transverse portion. The garment receiving slots are adapted to receive therein (a) a tie label, and (b) a shirt or blouse. The tie clip operates by fixedly attaching to both the tie label and the shirt or blouse. As the tie label is normally sewn to the tie, the tie is thus secured by the tie clip relative to the shirt or blouse.

The first garment receiving slot is formed between a body and a first transverse portion. A spring means is provided to urge the first garment receiving slot toward a closed position by urging the first transverse portion toward the body. The first garment receiving slot may be positively actuated to an open position to receive a tie label therein by simply providing a slight amount of manual opening pressure to oppose said spring means, then sliding the tie label receiving portion over the label. Once the label is squarely and securely positioned therein, the manual pressure against said spring means may be relaxed, to allow the first garment receiving slot to return to a normally closed, clamping position, whereby the tie label may be frictionally engaged between the body portion and the first transverse portion, so as to securely engage the tie label.

A second transverse portion is mounted to the first transverse portion; the first and second transverse form therebetween a second garment receiving slot. The slot is urged toward a closed position by a second spring means, whereby a shirt or blouse may be frictionally engaged between the first and second transverse portions, so as to secure the tie clip thereto. This second garment receiving slot may be manually actuated to an open position to receive a shirt or blouse therein. Once the shirt or blouse is fully positioned therein, the second garment receiving slot may be allowed to return to a normally closed, clamping position.

My improved tie clip possesses the advantage that both the first spring means between the body and the first transverse piece, and the second spring means between the first transverse piece and the second transverse piece, are integrally formed from a single piece of material along with the body and transverse pieces which they connect. Thus, no separate spring spring or spring mounting means is required. As a result, there are no extra or extraneous parts to increase complexity or the costs of manufacture.

Preferably, each of the aforementioned spring means is integrally formed within connection portions (a) between the body and the first transverse portion, and (b) between the first transverse portion and the second transverse portion. Also, for additional friction, one or more dimples are formed in said body to project rearward toward said first transverse portion so as to enhance a pressure point for frictionally engaging the tie clip. Similarly, one or more dimples may be formed in said second transverse portion to project forward, so as to enhance a pressure point for frictionally engaging the shirt or blouse thereto.

Tie clips made according to the teachings herein differ from previously available products of which I am aware in one respect in that integral construction of the clip including spring means provides a simple, lightweight, easily used clip. When the springs are integrally manufactured with the clip, as in the preferred configuration shown herein, my clips will provide easy location of ties, while being comparable or lighter in weight than conventional or previously available clips. Moreover, my tie clip provides a hidden clip which avoids intrusion into an expensive tie, and avoids the use of magnets which are common in other types of hidden tie clips, but which are particularly undesirable in occupations involving handling of data on magnetic media.

OBJECTS, ADVANTAGES, AND FEATURES OF THE INVENTION

From the foregoing, it will be apparent to the reader that one important and primary object of the present invention resides in the provision of a novel, improved tie clip to provide a means easily and simply secure a tie to a shirt or blouse, thereby preventing or reducing the tie from hanging down or blowing into undesired positions.

Other important but more specific objects of the invention reside in the provision of a tie clip as described in the preceding paragraph which:

- can be manufactured in a simple , straightforward manner;
- results in an effective tie clip which can be hidden in use;
- have an integral spring means for securing a tie label to the clip;
- have an integral spring means for securing a tie clip to a shirt or blouse;
- in conjunction with the preceding two objects, have the advantage that the clips can be quickly engaged and disengaged; and therefore,
- provides a tie clip which is easy to use and re-use; and as a result,
- provides a means for safely and reliably locating a tie in a stationary position against a blouse or shirt.

Other important objects, features, and additional advantages of my invention will become apparent to the reader from the foregoing and the appended claims and as the ensuing detailed description and discussion proceeds in conjunction with the accompanying drawing.

BRIEF DESCRIPTION OF THE DRAWING

In the drawing:

FIG. 5 is a vertical cross-sectional view of the neck-tie of FIG. 1, taken as at line 5—5 of FIG. 1, looking downward on a tie clip in its working position, illustrating the embodiment first shown in FIG. 1 above.

FIG. 6 is a top view of the tie clip first illustrated in FIG. 1, now showing the clip in a loose, unused position, and revealing the main body, the first and second transverse portions, and particularly showing the integral spring means between the first and second transverse portions.

FIG. 7 is an side elevation view of the tie clip also illustrated in FIGS. 1, 2, 4, 5, and 6 above, showing the end as if viewed from the perspective of line 7—7 of FIG. 6.

FIG. 8 is a front perspective view of a third embodiment of my invention, showing a "downward" mounting main body, rather than an upward mounting main body as illustrated above.

FIG. 9 is a side view of the embodiment just set forth in FIG. 8 above, showing the appearance of a downward mounting clip which includes a bent, flanged, rearward tie label entry portion.

FIG. 10 is a side view of yet another embodiment of my tie-clip, showing a downward mounting type clip without a rearwardly extending flange portion.

DETAILED DESCRIPTION OF THE INVENTION

Figure 2:
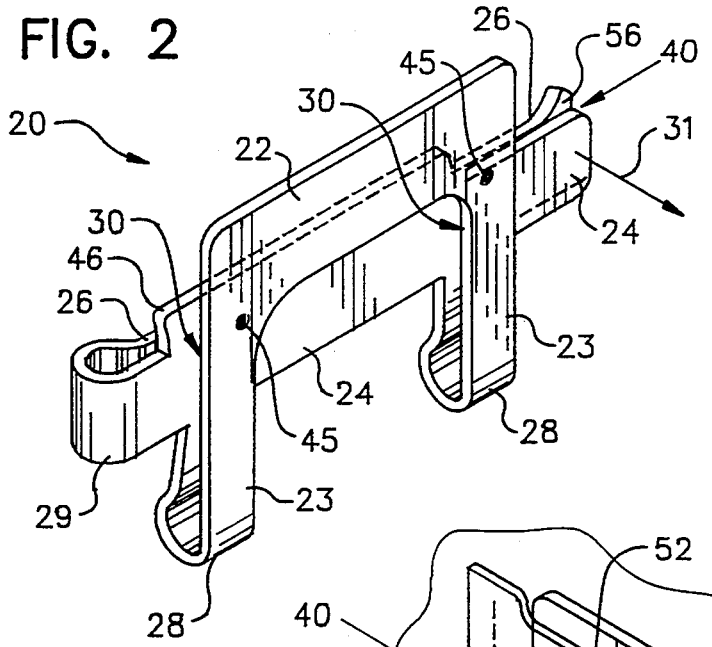
FIG. 2 is a perspective view of the tie clip first illustrated in FIG. 1, now showing the clip in a loose, unused position, and revealing the main body, the first and second transverse portions, and integral spring means.

Referring to FIG. 2 of the drawing, a tie clip 20 constructed in accordance with my invention comprises a body member 22, a first transverse portion 24, and a second transverse portion 26. The body 22 is connected by one or more preferably U-shaped fingers 23 to first transverse portion 24. Ideally, fingers 23 form a part of one or more first spring means 28 (two such springs shown). Preferably, as illustrated in this FIG. 2, the body member 22, fingers 23, first transverse portion 24, and first spring means 28 are integrally formed from a single piece of material, such as spring grade stainless steel. Similarly, a second spring means 29 is preferred for provision of the connection between the first transverse portion 24 and the second transverse portion 26.

A first garment receiving slot 30 is formed between the body 22 and first transverse portion 24. The first spring means 28 is provided with a bias to urge the first garment receiving slot 30 toward a closed position by urging the first transverse portion 24 toward the body 22, i.e., as indicated by the reference arrow 31 This operation may be seen in the vertical cross-sectional view provided in FIG. 5. In that figure, a forward tie portion 33 is provided with a rearward side 34 having a tie label 36 affixed thereto. The forward tie portion 33 is shown positioned forward of a shirt 38. The first garment receiving slot 30 may be positively actuated to an open position to receive the tie label 36 therein by simply providing a slight amount of manual opening pressure to oppose said spring means 28, then sliding the first garment receiving slot 30 upward behind the label 36. Once the label 36 is squarely and securely positioned in the first garment receiving slot 30, the manual pressure against said spring means 28 may be relaxed, to allow the first garment receiving portion to return to a normally closed, clamping position.

Between the first transverse portion 24 and the second transverse portion 26 is formed a second garment receiving slot 40. The second garment receiving slot 40 is adapted to receive therein the edge or band 42 of shirt 38 or similar garment such as a blouse. The second garment receiving slot 40 is urged toward a normally closed position by second spring means 29. The second garment receiving slot 40 may be manually actuated to an open position to receive the edge or band 42 of a shirt or blouse therein. Once the band 42 is fully positioned therein, the second garment receiving slot 40 may be allowed to return to a normally closed, clamping position, wherein the band 42 is firmly clasped between the first 24 and second 26 transverse portions.

Therefore, it can be seen that tie clip 20 operates by fixedly attaching to both the tie label 36 and to the band 42 of a shirt or blouse 38. As the tie label 36 is normally sewn to the rear 34 of forward tie portion 33, the forward tie portion 33 thus secured by the tie clip 20 relative to the shirt 38 or blouse.

Figure 1:
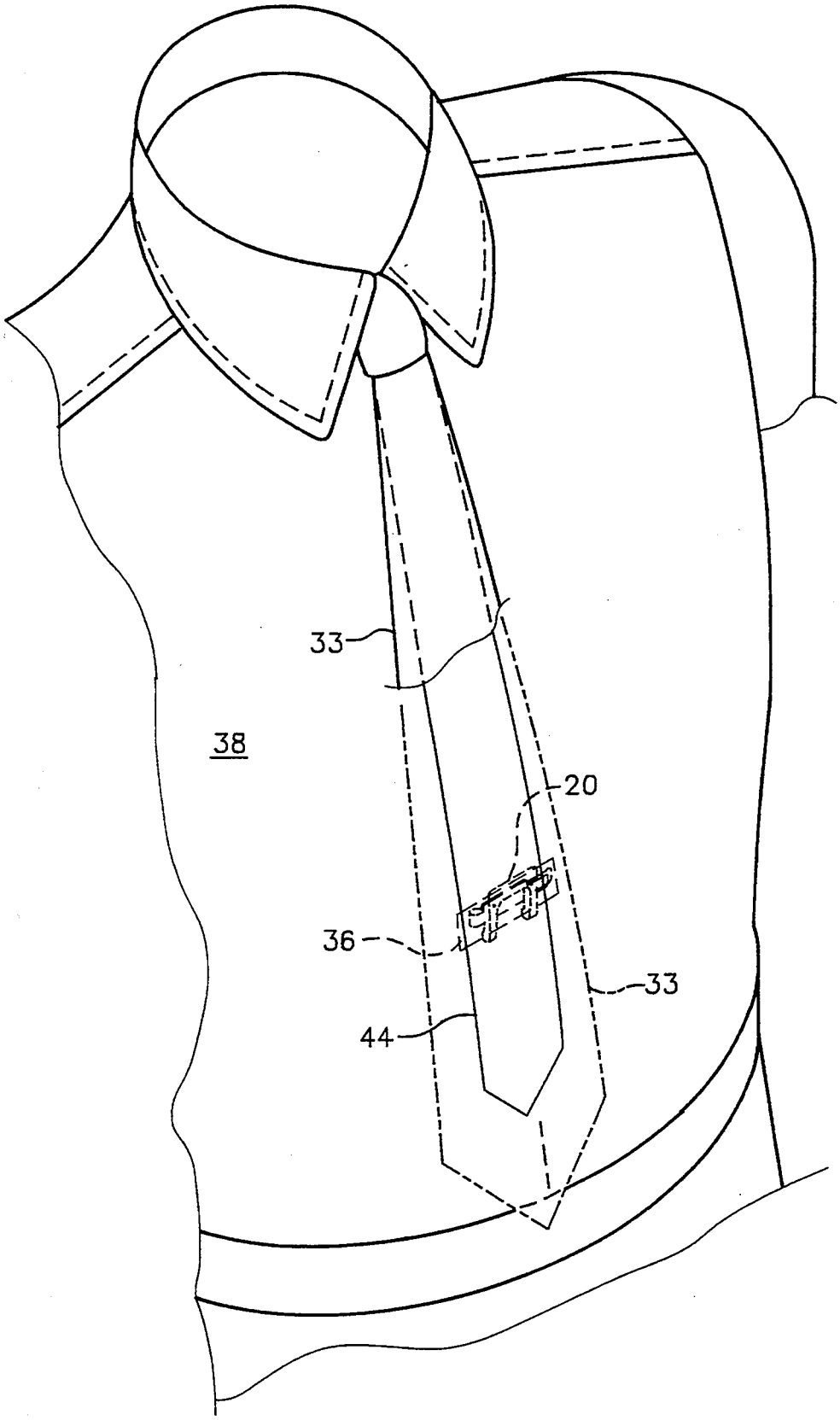
FIG. 1 is a perspective view of a shirt, showing a neck tie affixed thereto, and illustrating in broken lines the location of the tie clip of the present invention when in use.

Attention is now directed to FIG. 1, wherein the tie clip 20 is shown in hidden lines in an operative position behind both forward tie portion 33 and rearward tie portion 44, and in front of shirt 38. For simplicity in FIG. 5 above, the hidden tie portion 44 is not shown, although it will be readily understood that hidden tie portion 44 may usually be found inserted between forward tie portion 33 and the tie label 36, so as not to be left unsecured by tie clip 20.

Returning now to FIG. 2, it can be seen that my improved tie clip 20 possesses the advantage that both the first spring means 28 between the body and the first transverse piece 24, and the second spring means 29 between the first transverse piece 24 and the second transverse piece 26, are integrally formed from a single piece of material along with the body 22 and the transverse pieces to which they connect. Thus, no separate spring or spring mounting means is required. As a result, there are no extra or extraneous parts to increase costs of manufacture of my tie clip.

Also evident in FIG. 2 are friction increasing dimples 45 which are formed in body 22, one or more of which may be provided as pressure points against first transverse piece 24 so as to increase friction between tie clip 20 and shirt band 42. More specifically, dimples 45 provide increased friction between the shirt band 42 when the band 42 is placed in the garment receiving slot 30, and the slot 30 is allowed to remain at its normally closed position.

Figure 4:
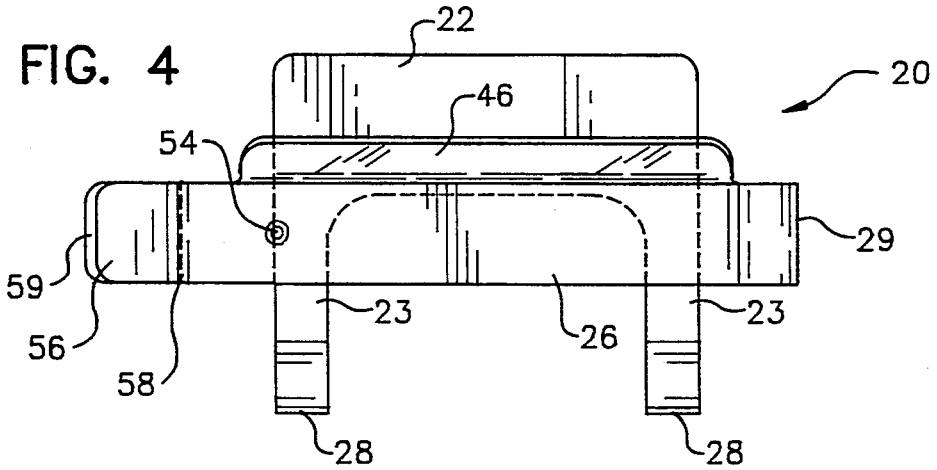
FIG. 4 is a rear elevation view of a tie clip according to the present invention, showing the embodiment first illustrated in FIGS. 1 and 2 above.

Turning now to FIG. 4, there is shown a rear view of the embodiment of my tie clip 20 as set forth in FIGS. 1, 2, 5, 6, and 7. In FIG. 4, a rearwardly extending flange portion 46 is seen extending upwardly from the first transverse portion 24. Ideally, this flange may extend rearward in the 30° to 45° from the vertical. The flange 46 is designed to guide the tie label 36 to the first garment receiving slot 30 between the body 22 and the first transverse piece 24.

Attention is now directed to FIG. 6, where a top view of the tie clip 20 is provided. Here, the rearwardly extending flange portion 46 can be clearly seen. This flange is an important improvement in providing an easily used tie clip.

FIG. 7 provides a side view of tie clip 20, taken as if from the perspective of line 7—7 of FIG. 6. Again, note the rearwardly extending flange 46. It is evident how this flange 46 provides a better entrance to garment receiving slot 30.

Figure 3:
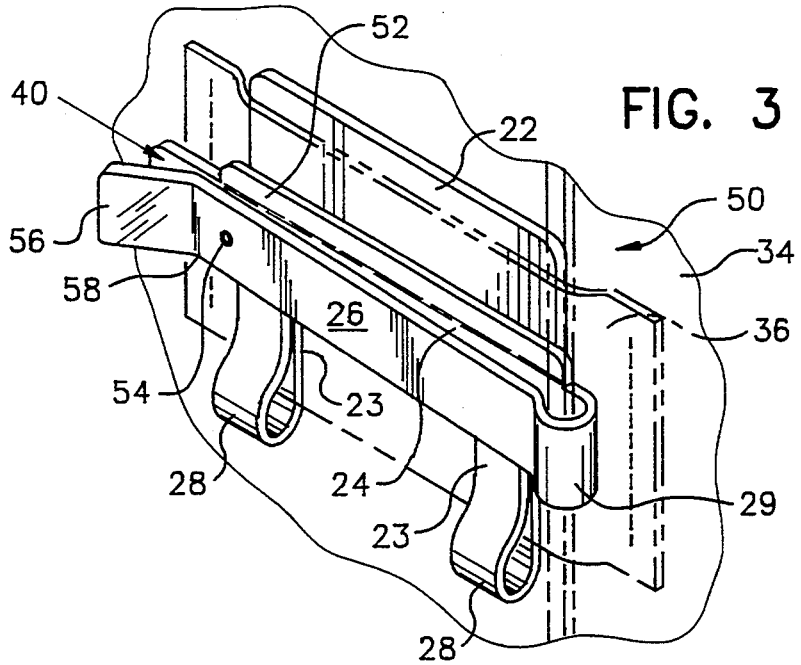
FIG. 3 is a rear perspective view of a second embodiment of my invention, shown as if located affixed to the neck-tie of FIG. 1; this embodiment does not use an angled receiving portion for engaging the neck-tie label.

A first alternate embodiment of my tie clip is illustrated as clip 50 of FIG. 3. Clip 50 is essentially identical to the clip 20 described above except that a flange 50 is provided extending only in the vertical direction, rather than also extending rearwardly.

Another feature common to both embodiments 20 and 50 is the provision of a dimple 54 in the second transverse piece 26. The dimple 54 serves to provide a pressure point between the first 24 and second 26 transverse pieces so as to increase the friction against a shirt band 42 which is located in the second garment receiving slot 40 therebetween, when the slot 40 is set free in its normally closed position. Yet another common feature visible is a laterally flanged end 56 of second transverse piece 26. This lateral flange 56 serves both to provide a means to manually manipulate the tie clip, as well as to assist in receiving a shirt band 42 into slot 40. Preferably, the flange 56 starts at a bend 58 in second transverse piece 26 in the one-quarter to one-half inch range from the distal end 59 of second transverse piece 26.

A second alternate embodiment of my invention is provided in tie clip 60 of FIG. 8. This embodiment provides a "downwardly fitting" tie clip 60, rather than the "upwardly fitting" type clip 20 or 50 described above. This type of clip 60 may be desirable so as to reduce any risk of loss of the clip 60, as the clip 60 is hung over tie label 36 and is caught thereby against the first spring means 28 portion of U-shaped fingers 23. FIG. 9 provides a side view of clip 60, where it can be seen that flange 66 extends downwardly and rearwardly. Mounting and use of this clip 60 should be easily achieved by the reader in view of the above provided description.

Yet another embodiment of my invention is illustrated in FIG. 10, wherein a "downwardly fitting" type clip 70 is provided, similar to that illustrated in FIGS. 8 and 8, but now having a vertical guide flange 76, rather than a rearwardly extending flange 66.

It will be readily apparent to the reader that the present invention may be easily adapted to other embodiments incorporating the concepts taught herein and that the present embodiments illustrated are shown by way of example only and shall not in any way be a limitation. For example, mirror image versions may be provided to accommodate the clasping of edges of garments opening from the opposite side from those shown. As to various embodiments illustrated in drawing, like parts have been noted with common reference numerals without further discussion thereof.

Thus, it can be seen that I have developed and have set forth herein an exemplary tie clip. The tie clip is of simple to manufacture unitary construction, and is lightweight and hidden in use, and does not damage the tie as is the case with many tie pins or tacks. The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalencies of the claims are therefore intended to be embraced therein.

I claim:

1. A hidden tie clip suitable for securing a necktie having a label to a shirt having a laterally projecting end portion, said tie clip comprising:

(a) a body;

(b) a first transverse portion, said body and said first transverse portion connected by two or more U-shaped fingers, said U-shaped fingers extending in a side-by-side relationship from said body, each U-shaped finger extending to and joining said first transverse portion at an orientation substantially perpendicular thereto, said U-shaped fingers forming a first spring means between said body and said first transverse portion, said first spring means biased toward a closed, contacting position so as to urge said first transverse portion toward said body to form a clasp therebetween;

(c) a second transverse portion, said first and said second transverse portions connected in an abutting relationship by at least one U-shaped flexible joint, said U-shaped flexible joint forming a second spring means, said second spring means biased toward a closed, contacting position so as to urge said second transverse portion toward said first transverse portion to thereby form a clasp therebetween;

(d) wherein said body portion, said first transverse portion, and said second transverse portions are sufficiently thin, in combination when assembled, so as to substantially avoid distortion of a necktie during use of said tie clip; and (e) so that a label of a necktie may be releaseably and securely inserted between said body and said first transverse portion, and so that a laterally projecting end portion of a shirt may be releaseably and securely inserted between said first and said second transverse portions, so as to securely position said tie clip in a hidden position behind a necktie, and so that said tie clip affixes a neck tie adjacent to a shirt when said tie clip is in use.

2. A tie clip as set forth in claim 1, wherein said body, said first transverse portion, and said first spring means are integrally formed from a common unitary part.

3. A tie clip as set forth in claim 2, wherein said part is comprised of spring steel.

4. A tie clip as set forth in claim 3, wherein said clip is stamped via means of a die, and wherein said spring is formed by bending said die-formed pieces.

5. A tie clip as set forth in claim 1, wherein said first transverse portion, said second transverse portion, and said second spring means are integrally formed from a common unitary part.

6. A tie clip a set forth in claim 1, wherein said first transverse portion further comprises a rearwardly extending first flange portion, said first flange portion adapted to engage a tie label and guide the same toward the friction position between said body and said first transverse portion.

7. A tie clip as set forth in claim 1, wherein said second transverse portion further comprises a rearwardly extending second flange portion, said second flange portion adapted to engage a shirt end and guide the same toward the friction position between said first transverse portion and said second transverse portion.

8. A tie clip as set forth in claim 1, wherein said body further comprises one or more dimples, said dimples suitable for increasing friction between a tie label and the body and first transverse portion.

9. A tie clip as set forth in claim 1, wherein said second transverse piece further comprises one or more dimples, said dimples suitable for increasing friction between a shirt end and the and first and second transverse portions.

10. A tie clip as set forth in claim 1, wherein said first spring means comprises a downwardly directed U-shaped finger.

11. A tie clip as set forth in claim 1, wherein said first spring means comprises an upwardly directed U-shaped finger.

* * * * *